US006203176B1

(12) United States Patent
Gordin

(10) Patent No.: US 6,203,176 B1
(45) **Date of Patent: *Mar. 20, 2001**

(54) INCREASED EFFICIENCY LIGHT FIXTURE, REFLECTOR, AND METHOD

(75) Inventor: Myron K. Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/429,200

(22) Filed: Oct. 28, 1999

Related U.S. Application Data

(63) Continuation of application No. 09/211,670, filed on Dec. 14, 1998.

(51) Int. Cl.[7] ..... F21V 7/00

(52) U.S. Cl. ..... 362/350; 362/348; 362/346; 362/297

(58) Field of Search ..... 362/297, 304, 362/305, 346, 350, 348

(56) References Cited

U.S. PATENT DOCUMENTS

| | | | |
|---|---|---|---|
| 707,982 | 8/1902 | Taylor . | |
| 731,084 | 6/1903 | Taylor . | |
| 1,133,955 | 3/1915 | Gray | 362/297 |
| 1,330,009 | 2/1920 | Romaine | 362/346 |
| 1,594,748 | 8/1926 | Neave . | |
| 1,799,899 | 4/1931 | Heile . | |
| 3,740,545 | 6/1973 | Franklin et al. | 362/297 |
| 4,066,887 | 1/1978 | Levis | 362/341 |
| 4,087,682 | 5/1978 | Kolodziej | 362/297 |
| 4,308,573 | 12/1981 | McNamara, Jr. | 362/297 |
| 4,338,655 | 7/1982 | Gulliksen et al. | 362/297 |
| 4,351,018 | 9/1982 | Fratty | 362/297 |
| 4,404,620 | 9/1983 | Takahashi et al. | 362/346 |
| 4,423,471 | 12/1983 | Gordin et al. | 362/96 |
| 4,428,038 | 1/1984 | Ratitsch et al. | 362/297 |
| 4,545,000 | 10/1985 | Fraley et al. | 362/297 |
| 4,683,526 | 7/1987 | Krogsrud | 362/346 |
| 4,725,934 | 2/1988 | Gordin | 362/298 |
| 4,729,077 | 3/1988 | Gordin et al. | 362/285 |
| 4,809,147 | 2/1989 | Negishi | 362/347 |
| 4,816,974 | 3/1989 | Gordin | 362/261 |
| 4,855,884 | 8/1989 | Richardson | 362/346 |
| 4,855,886 | 8/1989 | Eijkelenboom et al. | 362/346 |
| 4,864,476 | 9/1989 | Lemons et al. | 362/297 |
| 4,945,454 | 7/1990 | Bunse et al. | 362/297 |
| 4,947,303 | 8/1990 | Gordin et al. | 362/261 |
| 4,979,086 | 12/1990 | Heinisch | 362/297 |
| 5,016,150 | 5/1991 | Gordin et al. | 362/263 |
| 5,075,828 | 12/1991 | Gordin et al. | 362/297 |
| 5,272,408 | 12/1993 | Levin et al. | 362/297 |
| 5,287,259 | 2/1994 | Lautzenheiser | 362/341 |
| 5,313,379 | 5/1994 | Lemons et al. | 362/346 |
| 5,355,290 | 10/1994 | Tickner | 362/297 |
| 5,402,327 | 3/1995 | Gordin et al. | 362/298 |
| 5,519,590 | 5/1996 | Crookham et al. | 362/62 |
| 5,607,229 | 3/1997 | Rykowski et al. | 362/346 |

*Primary Examiner*—Laura K. Tso
(74) *Attorney, Agent, or Firm*—Zarley, McKee, Thomte, Voorhees & Sease

(57) ABSTRACT

An apparatus and method for increasing the efficiency of reflectors used in high intensity wide area lighting includes a reflector with an interior surface and a very high total reflectivity material overlaid on at least part of the interior surface of the reflector.

44 Claims, 7 Drawing Sheets

10B
10C–10C
18D
12
10B 12
18D 18D
12

30
34

INCREASED EFFICIENCY LIGHT FIXTURE, REFLECTOR, AND METHOD

This application is a continuation of Ser. No. 09/211,670 filed Dec. 14, 1998.

BACKGROUND OF THE INVENTION

A. Field of the Invention

The present invention relates to lighting fixtures, and in particular, to lighting fixtures, reflectors, and methods for lighting large areas such as athletic fields from substantially elevated positions.

B. Problems in the Art

Outdoor sports field lighting (e.g. football fields, baseball diamonds, softball fields) are generally lit by suspending a plurality of fixtures on several poles spaced around the fields. A commonly used light fixture for sports lighting is what is called the symmetrical reflector fixture. FIG. 1 illustrates the basic shape of such a fixture.

A symmetrical, bowl shaped reflector 12 is mounted to a mounting structure 14. A lamp 16 generally screws into mounting structure 14. A lens (not shown) is fastened over the front of the reflector 12.

By utilizing a high intensity discharge lamp for lamp 16, the shape of the reflector in combination with reflector 12 can produce a controlled, concentrated, high intensity beam that is useful for sports lighting. A significant advantage to this arrangement is the cost-effectiveness of reflector 12. It can be made of aluminum material, does not require any other supporting structure, and is not subject to rust or corrosion from the outside environment.

The most cost-effective ways to form reflector 12 is to spin it into shape or hydroform it. These are economical ways to make them in large quantities.

First, however, any such forming process cannot be perfect or absolutely repeatable. In other words, because of inherent factors in the manufacturing process, a perfect shape or perfect surface cannot be made during the forming process. Therefore, significant post-forming work is generally required on the interior of the reflector 12. For example, it might be polished, etched, or otherwise worked to assist in creating a desired surface and light output.

It is also to be understood that spun aluminum has on the order of 80% reflectivity. Reflectivity involves a measurement of the amount of light which is reflected from a surface as opposed to being absorbed by the surface. Therefore, 20% or more of the light is absorbed.

There are materials that have higher reflectivity. In fact, some of these materials have reflectivity values on the order of 87% to 97%. Moreover, these materials can be made to be highly specular. Specularity defines what happens to light when it hits the surface. In other words, a highly specular surface is mirror-like. Light will very accurately and uniformly reflect depending on its angle of incidence. A non-specular or highly diffuse surface causes incident light to reflect or spread in all different directions.

Often a controlled amount of spread is desirable to smooth out the light beam. However, it is generally undesirable to have so much spread as to place light outside the desired beam dimension. Controlling the surface on a spun reflector to obtain the desired characteristics discussed above is very difficult and requires a continuous, close control in the spinning and post-forming processes.

Specularity is different than reflectivity. One can have a highly specular surface (polished black marble) with low reflectivity (the black marble absorbs a good portion of the light). Conversely, the high reflectivity material described above not only can be made to be highly reflective (up to 97% reflection with only 3% absorption) but also can be made to be highly specular (mirror like) or diffuse or in between.

It is important to understand that with respect to sports lighting, there are times when you want a surface to be highly specular and times you want it to be diffuse, or in between. In any case though, it is beneficial if reflectivity can be as high as possible because the efficiency of the fixture increases. Light which otherwise would be absorbed and therefore lost from the fixture, can be used for the lighting project.

Therefore, a significant problem in the art is the fact that efficiency is lost by utilizing conventionally manufactured aluminum reflectors. There is room for improvement in efficiency by increasing the total reflectivity of such reflectors.

It is therefore a principal object of a present invention to provide an increased efficiency light fixture, reflector, and method that improves upon the state of the art and solves problems in the state of the art.

Other objects, features, and advantages of the invention include:

1. A reflector that is economically produced yet is highly efficient with respect to total reflectivity.
2. A highly efficient reflector that can have its reflective characteristics varied according to selection and need.
3. A efficient reflector that can be combined with other components to make up a light fixture that is highly efficient and flexible with regard to its light output characteristics and beam characteristics.
4. A reflector that can be used in a light fixture which is durable, flexible, and economical.
5. A light fixture, reflector, and method that is useful in controlling the spread of a light beam and in the shaping of the beam to a configuration which can more closely match the target areas being lighted.

These and other objects, features, and advantages of the present invention will become more apparent with reference to the accompanying specification and claims.

SUMMARY OF THE INVENTION

The apparatus according to the invention overlays one or more segments of a very high total reflectivity material over at least a portion of the interior surface of a symmetrical reflector. The segments can be uniform or can vary in size, shape, and specularity. Such variances in the segments can intentionally be used to effect the beam shape and characteristics. The segments have a higher total reflectivity than the interior surface of the reflector. By utilizing the segments, the total efficiency of the reflector can be increased. Utilization of one, or a number of such reflectors, can increase total efficiency for a lighting project that requires a plurality of lighting fixtures, which can reduce the number of fixtures needed and save installation and operating costs. It can also improve the ability to control the beams issuing from lighting fixtures to match the needs of a target area or lighting project.

The method according to the present invention overlays a very high total reflectivity material over at least a portion of the interior of a symmetrical reflector that is selected for a high intensity, wide scale lighting application. The method includes as options the shaping of the overlaid material into segments or pieces and, if desired, varying the specularity of the entire overlaid material or portions thereof to effect beam shape and characteristics.

BRIEF DESCRIPTION OF THE DRAWINGS

FIG. 6 showing a relatively narrow segment and FIG. 7 a relatively wide segment.

FIG. 10D shows the contribution to the beam spread generated from a fixture that would include the segment of FIG. 10A as compared to the contribution of the segment shown in FIG. 9A.

DETAILED DESCRIPTION OF THE PREFERRED EMBODIMENT

Figure 2:
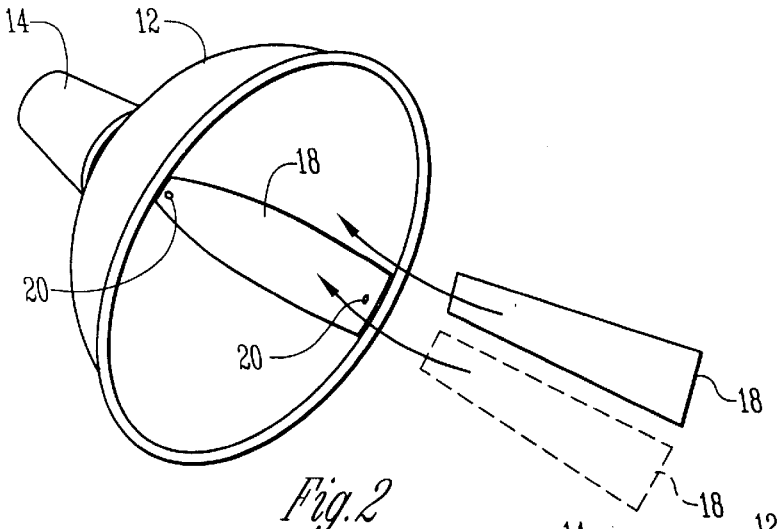
FIG. 2 is similar to FIG. 1 but illustrates a segment of material overlaid onto the symmetrical reflector, and in exploded form, how additional segments would be mounted into the reflector.

To assist in an understanding of an invention, a preferred embodiment or embodiments will now be described in detail. Reference will be frequently taken to the drawings which are summarized above. Reference numerals will be used to indicated certain parts and locations in the drawings. The same reference numerals will be used to indicate the same parts or locations throughout the drawings unless otherwise indicated.

Figure 1:
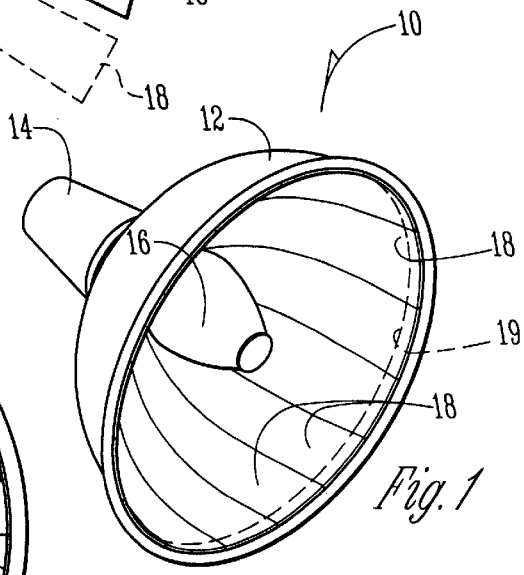
FIG. 1 is an isolated perspective view of a symmetrical reflector, a bulb cone, a lamp, and overlaid material on the interior surface of the reflector according to an embodiment of the present invention.

By referring to FIG. 1, the invention involves utilizing, almost as a framework, spun reflector 12 and adding inserts 18 to the interior of reflector 12. Inserts 18 are generally triangularly or pie-piece shaped segments with straight inner and outer edges which are mounted side by side into reflector 12. FIG. 2 illustrates the general shape of two segments 18 and illustrates how they would then be inserted side by side into reflector 12. They could be screwed, bolted, riveted, adhered or otherwise mounted to reflector 12. FIG. 2 shows screws 20 as an example of attachment of segments 18 to reflector 12.

One way to mount segments 18 into the interior of reflector 12 would be to utilize a tape having adhesive on both sides to adhere to the interior of reflector 12 and to the back side of each segment 18 so that the segment 18 can conform to the shape of the interior of reflector 12 and be held in place. Retainer rings could also be utilized to help secure segments 18 into reflector 12. One ring could be placed near the front perimeter opening of reflector 12 (shown by ghost line 19 in FIGS. 1 and 3) and the other ring around the narrow ends of segments 18 near the interior apex of reflector 12 (shown by ghost line 21 in FIG. 3). The rings could be attached in place by a number of methods, including those mentioned above such as screws, bolts, rivets, or otherwise. Other forms of securement of the ends of segments 18 could be used.

Segments 18 have the characteristic of having a highly reflective material for their outwardly facing surface. By inserting them into reflector 12, a significant increase in efficiency is achieved over the on the order of 80% reflectivity of spun aluminum. In short, use of segments 18 gets more light out of the fixture; light which is then usable for the lighting project. It is possible to increase efficiency by 10% or more.

Another advantage of the above-described fixture is that reflector 12 can be formed by the cost effective, economical spinning of the reflector and no post forming, polishing, or work needs to be done, also saving time, resources, and money. Again, the spun reflector does not have to be worked upon to achieve any type of reflecting surface. Insert segments 18 merely need to be placed into reflector 12. Economy is also gained in that the quality of the tooling to spin the reflector does not have to be as high, and the control of the surface of reflector 12 from spinning does not have to be as precise, as normally would be desired if creating a spun reflector without modification according to the invention.

A still further advantage is that any of the segments 18 can be fine tuned with respect to both the width of a segment (the wider the segment the wider the beam; the narrower the segment the narrower the beam) and specularity (more specular for more control; more diffuse for less control). Additionally, any segment 18 can be specifically shaped to give a beam or part thereof a particular configuration or characteristic.

Finally, allowing this fine tuning and using segments 18 eliminates the problems that spun reflectors have with light striations and spottiness because of the inherent deficiencies in the process.

Therefore, the invention allows selection of specularity with more efficiency because of the high reflectivity of the reflecting surface not possible with spun reflectors.

It is to be understood that a spun reflector, as the framework for the segments 18, is not necessarily required. Some sort of a shroud or framework could be used instead. However, the present embodiment utilizes the spun reflector 12 because it is fairly economical because, inter alia, tooling readily exists and it is widely known and used to form the reflector, and because post-forming work does not need to be done. The invention also allows retrofitting of existing fixtures having spun reflectors (but indeed could be used for any existing symmetrical fixture).

Figure 3:
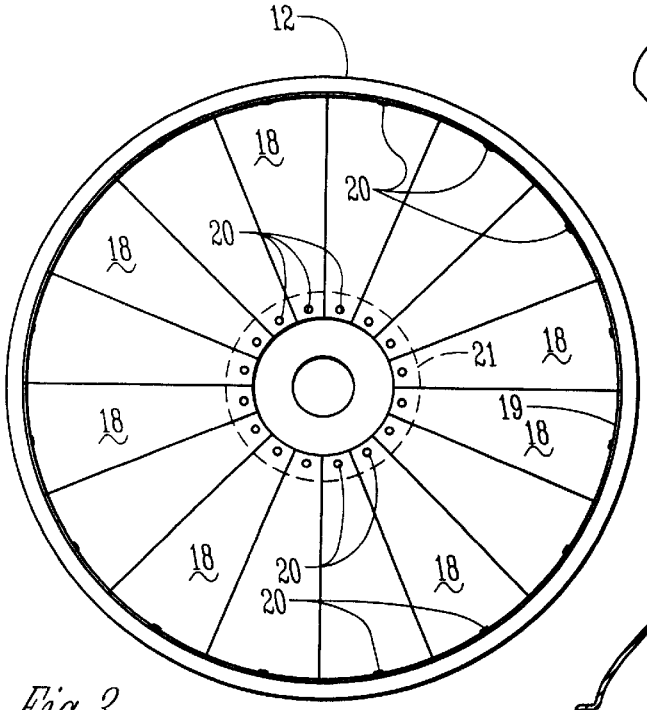
FIG. 3 is a slightly enlarged front elevational view of FIG. 1.

FIG. 3 shows from a front elevational view the installation of segments 18 into the interior of reflector 12, including screws 20 at opposite ends of each segment 18 for attachment into reflector 12. Double sided adhesive tape or substrate with retainer rings could also be used, as described above. Other forms of mounting could also be used.

Figure 4:
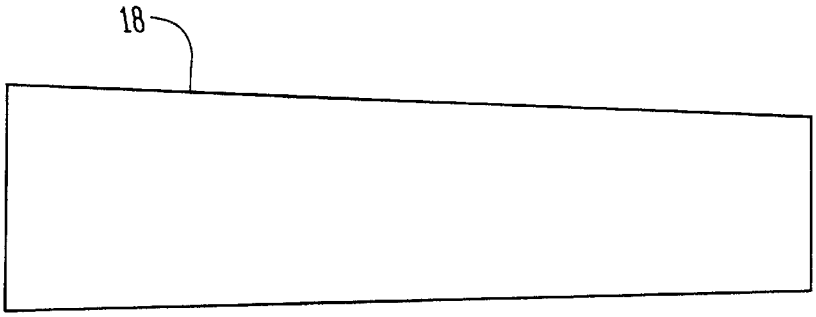
FIG. 4 is plan view of a segment shown in FIGS. 1 and 2 prior to being fitted into the symmetrical reflector.
Figure 5:
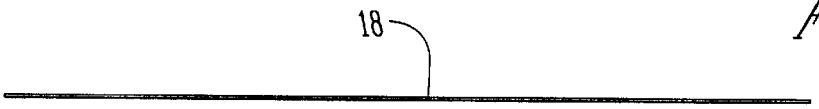
FIG. 5 is an edge view of FIG. 4.

FIGS. 4 and 5 illustrate the basic shape of one type of segment 18. When manufactured, it can be made out of a flat material having diverging opposite sides and parallel or truncated opposite ends. When inserted into reflector 12, each segment is bowed or sculpted to simulate the surface of revolution of the bowl-shaped, symmetrical reflector 12. This can be done by a variety of methods known or within the skill of those skilled in the art. For example, a segment 18 can be curved to approximately the shape of reflector 12 through a rolling machine or by hitting it with a die. Another example is to simply define two locations on the reflector interior where a segment 18 is to ultimately pinned or secured, and then pin or otherwise secure one end in place, and then pin or otherwise secure the other end, and in that process direct the intermediate portion of the segment against the reflector. A still further example is to pre-bend the segment to an approximate conforming shape, and then complete a conforming shape while using adhesive to hold it in place. Other methods are possible such as using retainer rings, as previously described, near the opposite ends of the segments and slightly over bending the segments, using the retainer rings to bend the segments back towards a conforming shape to the reflector.

It would also be possible to place a frame around the segments, and the frame itself could be changed or be adjustable to change the shape of the segments. It would even be possible to dye cast the symmetrical housing or reflector to a shape close enough to utilize the inserts to make the final reflecting surface. Similarly, segments could be interchanged from one shape reflector to another.

One material that can be utilized for segments 18 is sold by Alanod®, Aluminum-Veredlung GmbH, Egerstrasse 12, D-58256 Ennepetal, Germany, Postfach 1102, D-58240 Ennepetal, under the trademark Miro®. For example, Miro® product DIN 5036 has a total reflection of 95%. It is made of a pretreated aluminum coil covered by super reflective and reflection reinforcing layers using a physical vapor deposition process. The vapor deposits layers of pure aluminum (Al 99.99%) that is completely iridescent free. It can be made in a variety of gauges, widths, and total reflection values, as well as different specularities and other reflection characteristics. It should be understood, however, the invention is not limited to this particular material but rather is based on the concept that an overlay of a higher total reflectivity material can increase efficiency of a reflector even of a heretofore fairly high total reflectivity reflector.

Figure 6:
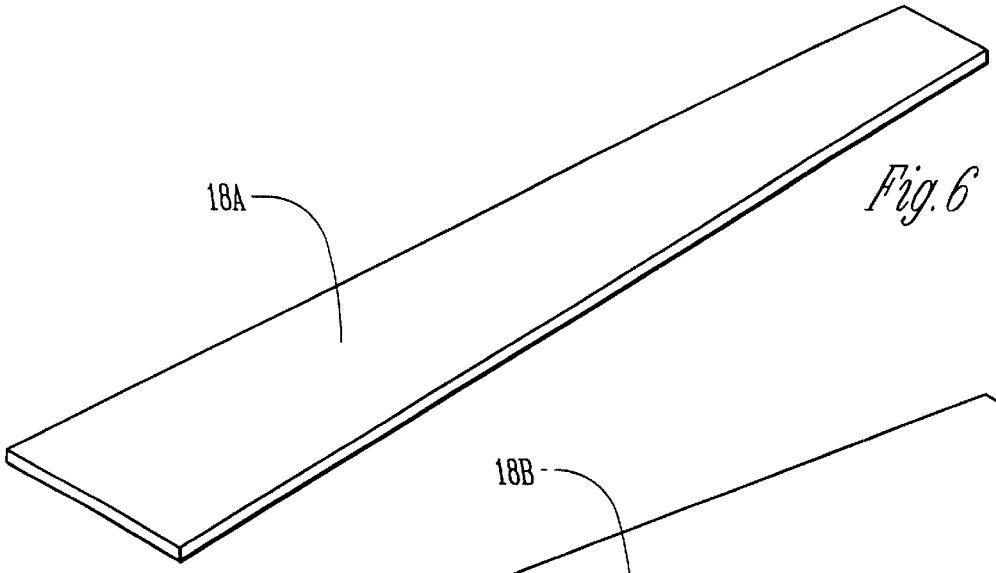
FIGS. 6 and 7 show alternative embodiments for a segment.
Figure 7:
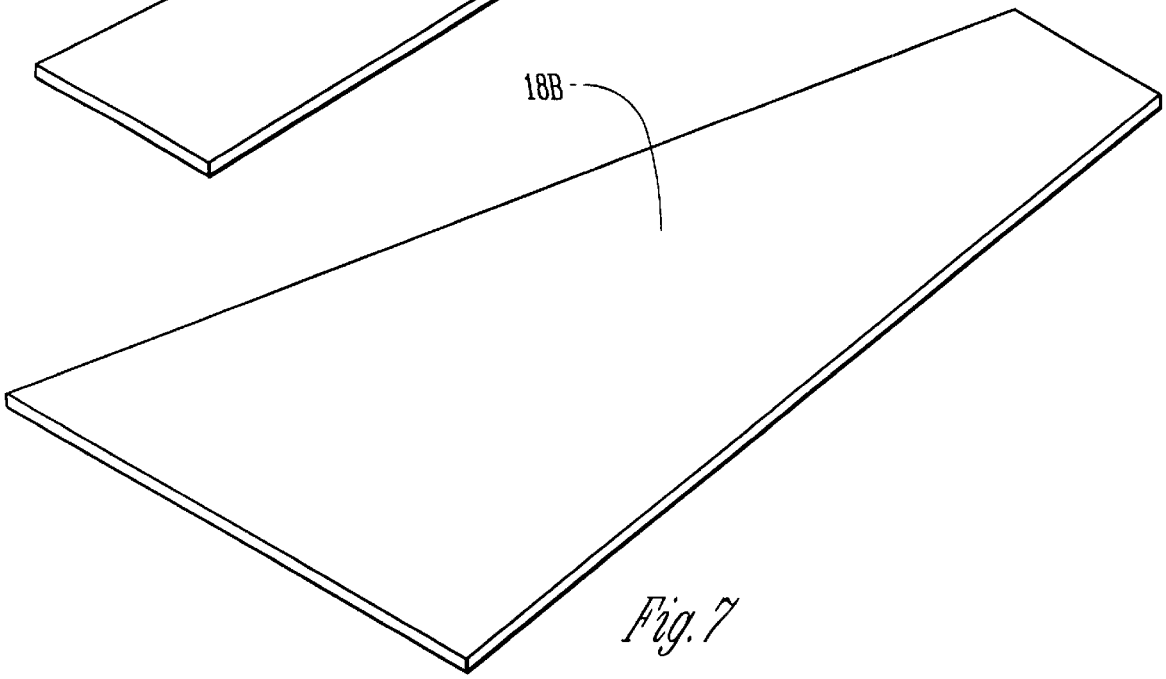

Following is an optional feature of the present invention. If the overlay onto the symmetrical reflector interior surface is made of segments such as shown in the drawings, they can be varied in width to vary the width of the fixture utilizing the reflector. For example, if relatively narrow segments 18A of FIG. 6 are used around a reflector 12, they would produce a comparatively narrow beam of light if all other factors are the same, whereas relatively wide segment 18B of FIG. 7 would generally produce a relatively wide beam from the fixture.

Another optional feature is to vary the specularity of the overlaid material according to need or desire. For example, the entire overlaid surface could be made highly specular for narrower beams. Making the entire surface more diffuse would widen the beam. The methods for changing specularity are well known in the art. Examples would be etching, peening, or fluting.

Moreover, such things as segment width and varying specularity, could be mixed and matched so to speak, in the same reflector to create different beam characteristics and light output characteristics according to desire or need. For example, by placing wider segments such as 18B of FIG. 7 on the top and bottom of the interior of reflector 12, but narrower segments such as 18A of FIG. 7 on the sides, could cause the beam shape to be wider horizontally and narrower vertically. Narrower segments on the top and bottom and wider segments on the side would cause the beam shape to be narrower horizontally and wider vertically.

Texturing alone can quite accurately produce beam spreads that vary according to texturing.

Figure 8:
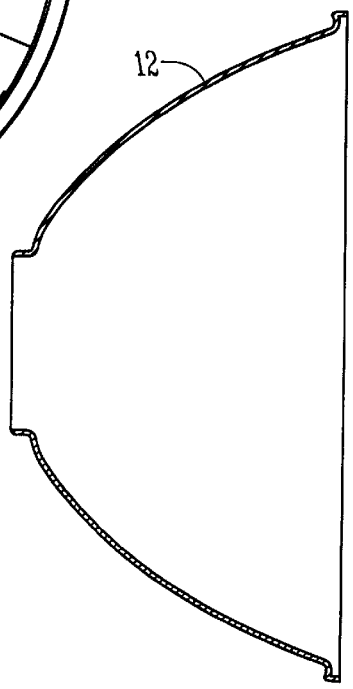
FIG. 8 is a side elevational cross sectional view of a reflector according to FIGS. 1–3, with the section taken along the central axis of the reflector.

FIGS. 8 through 13A–D illustrate additional options according to the present invention. FIG. 8 illustrates in cross-sectional elevational form a reflector 12; a conventional symmetrical reflector. FIG. 9A shows the interior of reflector 12 with a single insert or segment 18C attached therein for representative purposes. In FIG. 9A, segment 18C is attached at the "6 o'clock position". In this instance, segment 18C is curved to conform closely with the surface of reflector 12, and as such, is curved along its longitudinal axis and laterally to essentially mimic the curvature of the portion of the rotated surface of revolution that defines the shape of reflector 12. FIGS. 9B and 9C illustrate the relationship of segment 18C to reflector interior 12 in more detail.

Figures 9A, 9B, 9C, 9D:
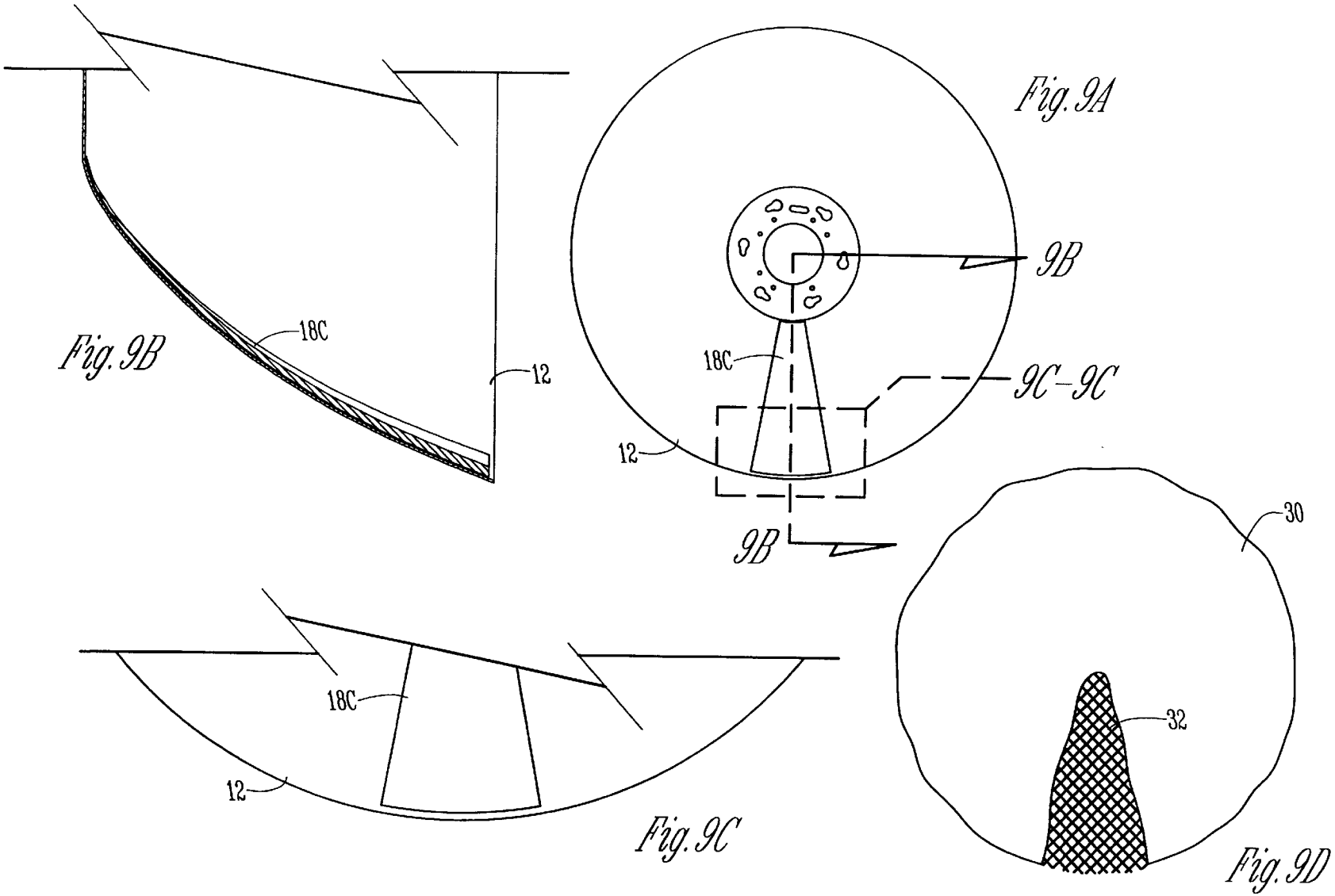
FIG. 9A is a front elevational view of the reflector of FIG. 8 with one segment of a certain configuration placed in position in the interior of the reflector.
FIG. 9B is a slightly enlarged sectional view taken along line 9B—9B of FIG. 9A.
FIG. 9C is a sectional view taken along line 9C—9C of FIG. 9A.
FIG. 9D is a diagrammatic depiction of the beam spread issuing from a reflector such as shown in FIG. 9A, showing the contribution to the beam from the segment shown attached to the reflector in FIG. 9A.

Segment 18C of FIGS. 9A–9C, having its curved configuration, would contribute to a total light beam spread from reflector 12 of FIG. 9A as shown in FIG. 9D. The cross-hatched area indicated by reference numeral 32, indicates such a contribution to the total beam spread 30. It can be seen that contribution 32 relative to total beam spread 30 is basically proportional to the size and shape of segment 18C of FIG. 9A relative to reflector 12. Contribution 32 does not alter the basic shape of the beam spread.

Figures 10A, 10B, 10C, 10D:
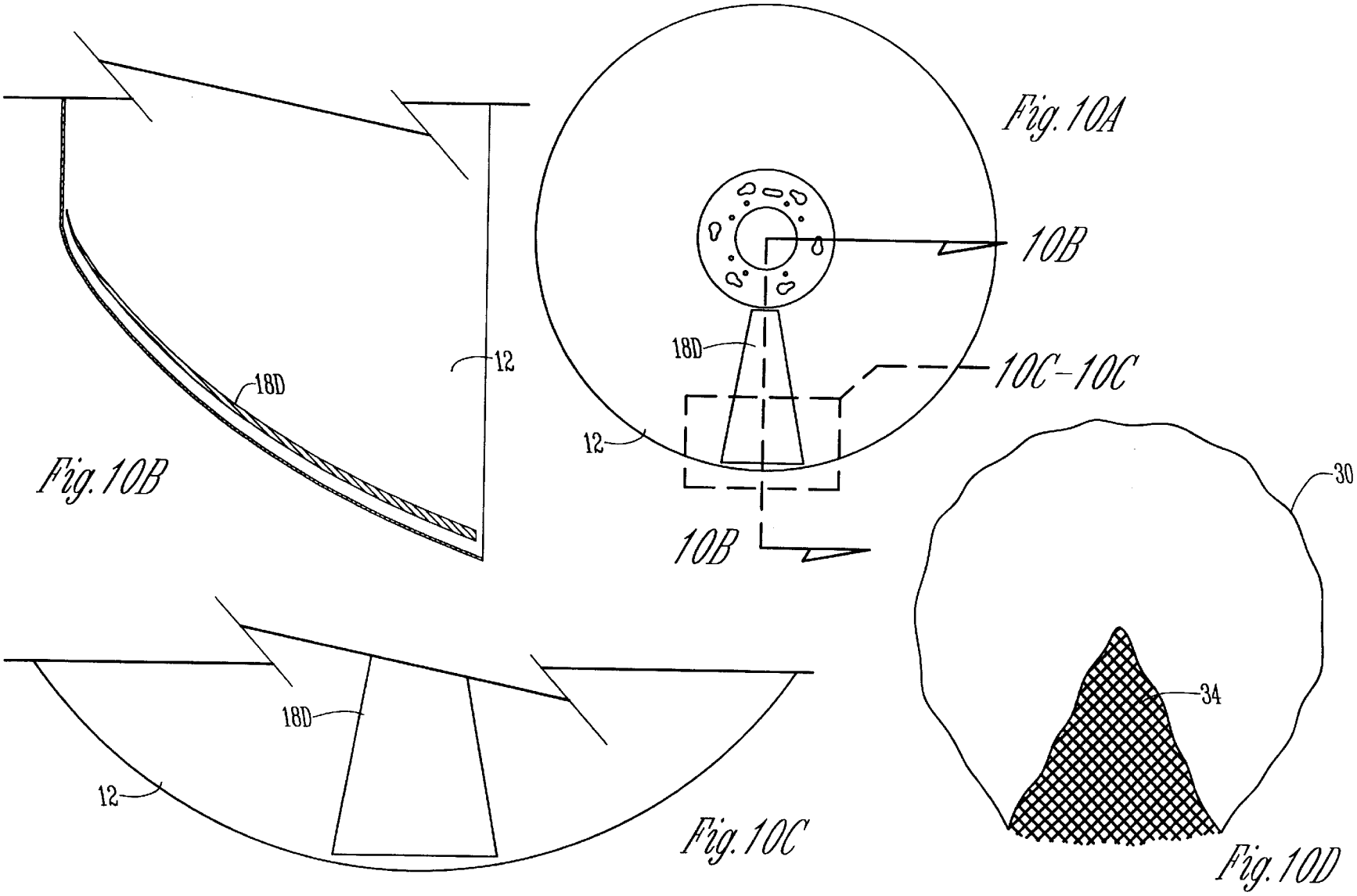
FIGS. 10A–10D are similar to FIGS. 9A–9D except that the segment in the interior of FIG. 10A is of a different configuration.

FIGS. 10A–10D are similar to FIGS. 9A–9D but illustrate a segment 18D that differs in configuration from segment 18C. §186 of FIG. 10A is formed so that it generally follows the shape of reflector 12 from its inner end to its outer end (see FIG. 10B), but is flat from side to side (or flat in one plane). The contribution 34 of segment 18D to beam 30 (FIG. 10D) would be wider than the corresponding contribution 32 of segment 18C of FIG. 9A, and would enlarge the general perimeter outline of beam spread 30 at and around 34.

FIGS. 11A–11D are similar to FIGS. 9A–9D except segment 18E includes flutes that are defined by raised edges 36 and lower edges 38 (See FIGS. 11B and 11C) that run between inner and outer ends of segment 18E. Segment 18E of FIG. 11A allows a directional spread to be made to its contribution 40 to beam spread 30. The contribution 40 of segment 18E to beam spread 30 spreads wider than that of segment 18C of FIG. 19A and enlarges the perimeter of beam spread 30 at and around 40.

Figures 11A, 11B, 11C, 11D:
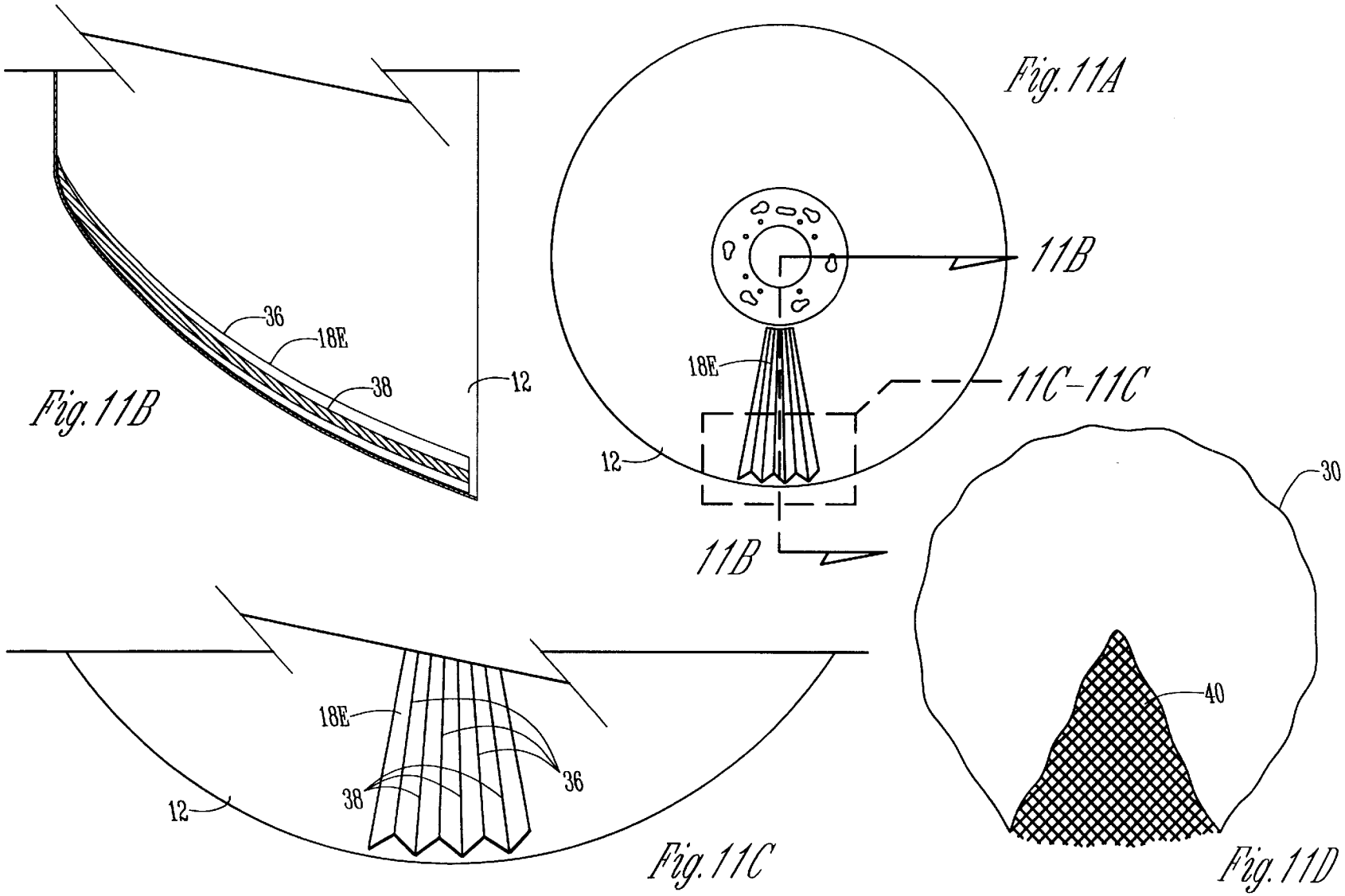
FIGS. 11A–11D are similar to FIGS. 9A–9D except the segment in FIG. 11A is fluted or corrugated in one direction, having a plurality of surfaces in different planes. The contribution of the segment shown in FIG. 11A to the beam spread shown in FIG. 11D can be seen.
Figures 12A, 12B, 12C, 12D:
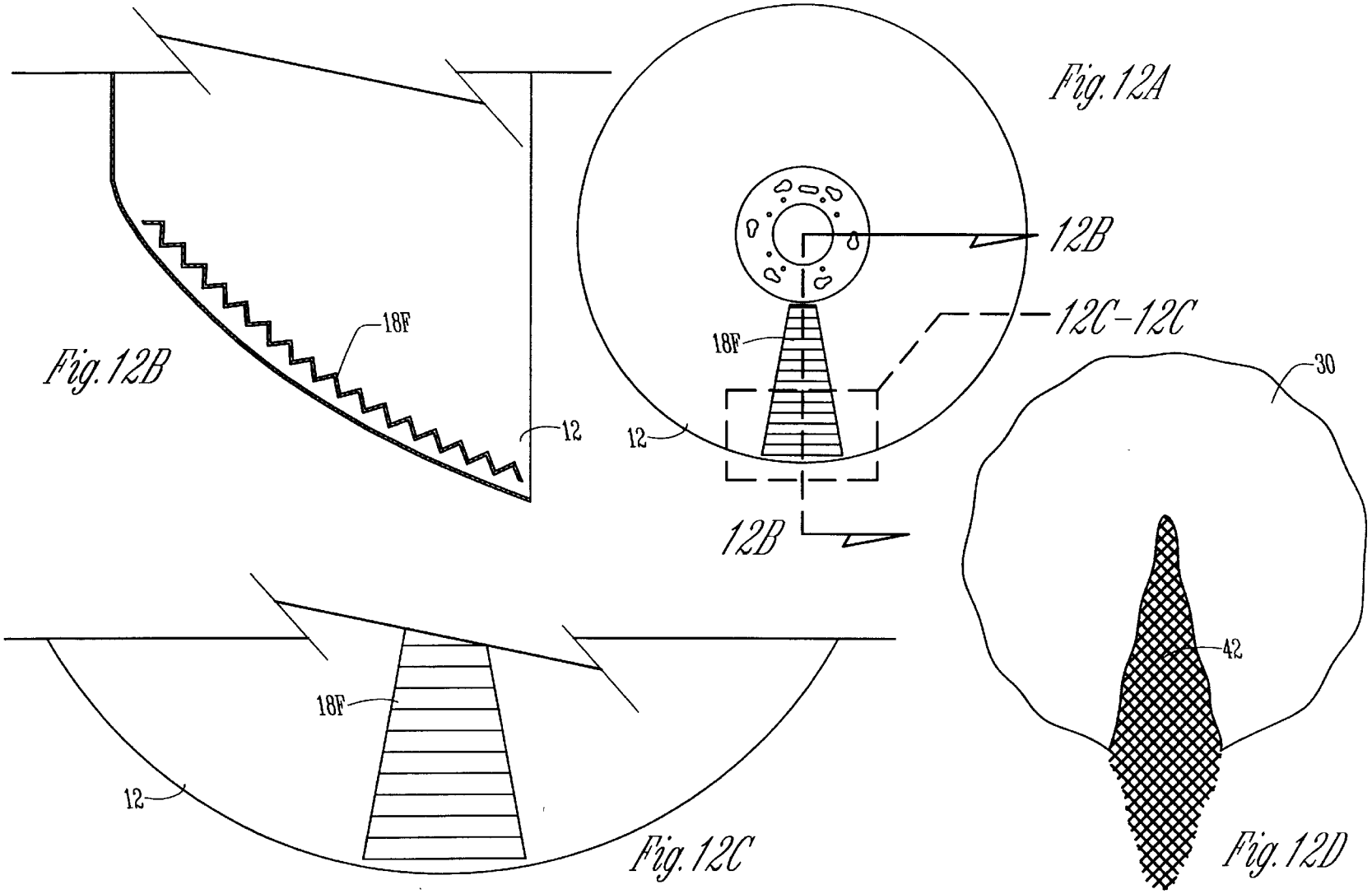
FIGS. 12A–12D are similar to FIGS. 9A–9D except that the segment shown in FIG. 12A has flutes in a different direction. The difference in contribution of the segment shown in FIGS. 12 to the beam spread is shown in FIG. 12D.

In comparison, FIGS. 12A and 12B, similar to FIGS. 9A–9D, illustrate a segment 18F that is fluted like segment 18E of FIG. 11A in the sense that it has raised edges 36 and lower edges 38, however, the flutes are lateral, from side edge to side edge of segment 18F, rather than longitudinal as they are in FIGS. 11A–11C. FIG. 12D shows the contribution of such a segment 18F of FIG. 12A (see reference numeral 42) to beam spread 30. It can be seen that the contribution 42 is directional in that it elongates radially relative to beam spread 30. Contribution 42 extends substantially outwardly of the perimeter of general beam spread 30, and extends past the center of beam spread 30 towards the opposite side of beam spread 30. Therefore, for example, utilizing a number of segments 18 of FIG. 12A on reflector 12 would result in an expanded beam spread as compared to beam spread 30 that would be produced by segments 18C of FIG. 9A if overlaid around the entire inside of reflector 12.

Figures 13A, 13B, 13C, 13D:
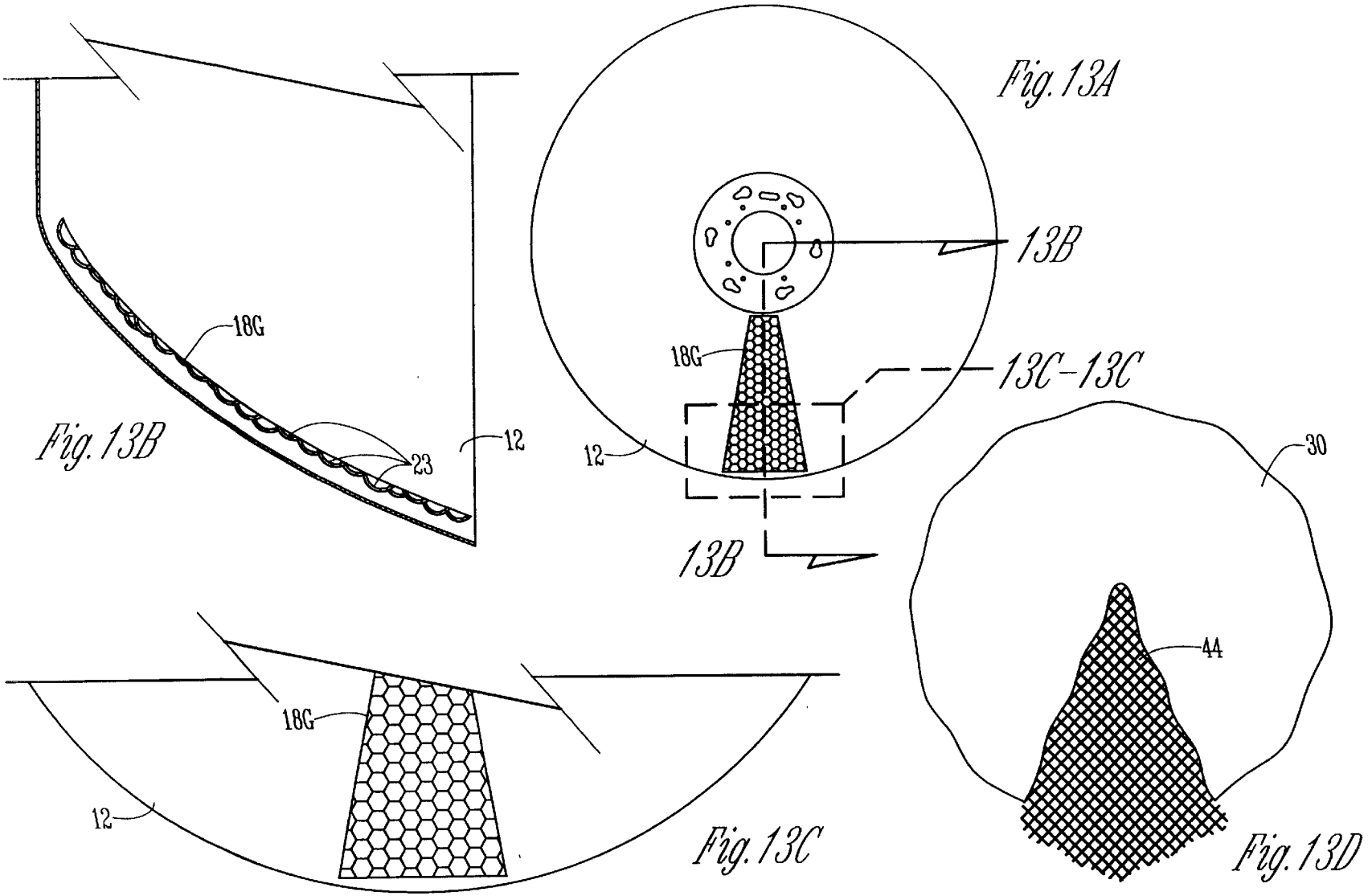
FIGS. 13A–13D are similar to FIGS. 9A–9D except the segment shown in FIG. 13A has dimples or peening. The contribution of the segment in FIG. 13A in the beam spread is shown in FIG. 13D.

FIGS. 13A to 13D, also similar to FIGS. 9A–9D, illustrate a segment 18G which has a textured, peened or dimpled surface made up of a number of small convex shape depressions 23 of varying diameters and depth (See FIG. 13B). In this instance, the peening results in a non-directional beam spread contribution 44 (see FIG. 13D) that is laterally wider and radially elongated, extending contribution 44 outside the regular perimeter of beam spread 30.

FIGS. 9A–9D, 10A–10D, 11A–11D, 12A–12D, and 13A–13D, are meant to illustrate a variety of examples of the ways segments 18 could be configured, and the corresponding effect on their contribution to a beam spread issuing from the reflector. As can be easily appreciated, from these drawings one can determine how the beam spread could be changed if one utilized a plurality of segments inserted in one reflector 12, whether the plurality of segments are the same or whether some or all are different.

It is to be understood that by mixing or matching different types of segments 18, different beam configurations can be achieved. All of these different types of segments 18 shown in the drawings can be used in conjunction with the use of the high reflectivity material. It is reiterated that different levels of specularity or diffuseness can also be utilized with any of the segments shown in the drawings to add a further factor with regard to the final beam spread characteristics and configuration.

It is to be understood that the invention does not require that segments of the specific shapes and/or characteristics of the drawings be utilized. Other shapes and/or characteristics are possible. Also, the invention does not require that segments, as shown in the drawings, be used but also contemplates the use of an overlay that could correspond to a larger part or all of the interior of reflector 12 than just a segment of the interior. To achieve maximum efficiency gain, the entire surface is generally overlaid. It is possible in some circumstances to pick up at least 15–18% efficiency increase.

It is to be understood also that inserts 18 could be placed at angles different than strictly conforming to the interior of surface of reflector 12 to change the beam characteristics and/or glare characteristics of the particular fixture. For example, a segment could have either its inner or outer end raised from the reflector surface. Such differences in angle could be done with one segment 18, several segments 18, or all segments 18 and would correspondingly change the beam eminating from the reflector.

It will be appreciated that the present invention can take many forms and embodiments. The true essence and spirit of this invention are defined in the appended claims, and it is not intended that the embodiment of the invention presented herein should limit the scope thereof. For example, reflector 12 has been described as being made of aluminum. Current conventional methods of making such aluminum symmetrical reflectors include spinning and hydroforming. It may also be possible to die-cast such reflectors out of aluminum or other materials. It may also be possible to make the general shape of the symmetrical bowl out of other materials including non-metal such as reinforced plastic.

What is claimed is:

1. A lighting fixture for high intensity, controlled, concentrated light beams to relatively distance wide area targets comprising:

a lamp;

a bowl-shaped symmetrical frame having an interior and exterior;

one or more segments placed over the interior of the frame.

2. The fixture of claim 1 wherein the total reflection is very high.

3. The fixture of claim 2 wherein the total reflection is in the approximate range of 85% to 97%.

4. The fixture of claim 3 wherein a segment is generally wedged shaped.

5. The fixture of claim 1 wherein each segment is variable in width.

6. The fixture of claim 5 wherein a segment is comparatively narrow to produce a comparatively narrow beam spread.

7. The fixture of claim 5 wherein a segment is comparatively wide to produce a comparatively wide beam spread.

8. The fixture of claim 4 wherein a segment has a textured surface.

9. The fixture of claim 8 wherein the textured surface is a peened surface.

10. The fixture of claim 8 wherein the textured surface has a specularity characteristic which in turn is related to beam spread.

11. The fixture of claim 1 wherein a segment has a fluted surface.

12. The fixture of claim 11 wherein the fluted surface has peaks and valleys running generally longitudinally of the segment.

13. The fixture in claim 11 wherein the fluted surface has peaks and valleys running generally laterally of the segment.

14. The fixture of claim 1 including a plurality of segments, at least some of the segments differing in width and texture from other segments.

15. A reflector used for producing high intensity, controlled concentrated light beams to relatively distant wide area targets comprising:

a bowl shaped shell with an interior surface;

a plurality of segments overlaid upon the interior surface of the shell.

16. The fixture of claim 15 wherein each segment is variable in its degree of specularity or diffuseness.

17. The reflector of claim 15 wherein the shell is a spun-aluminum bowl.

18. The reflector of claim 15 wherein the shell is a hydroformed bowl.

19. The reflector of claim 15 wherein the shell is dye cast out of metal.

20. The reflector of claim 15 wherein the shell is made of plastic.

21. The reflector of claim 15 wherein the total reflection is in the approximate range of 85% to 97% for each segment.

22. The reflector of claim 15 wherein each segment is wedged shaped and generally conformed to the shape of the reflector.

23. The reflector of claim 22 wherein the width of each segment is selected based on desired beam spread.

24. The reflector of claim 23 wherein specularity of each segment is selected on the basis of desired beam spread.

25. The reflector of claim 16 wherein a segment has a textured surface.

26. The reflector of claim 16 wherein a segment has a fluted surface.

27. The reflector of claim 15 wherein each segment is variable in width.

28. The reflector of claim 16 wherein each segment is variable in degree of specularity and diffuseness.

29. A method of increasing efficiency of a reflector used for high intensity, controlled concentrated light beams to relatively distant, wide area targets comprising:

selecting a frame with an interior surface;

overlapping a material of high total reflectivity over at least a portion of the interior surface of the frame;

a central aiming axis of the reflector;

central aiming axis of the reflector.

30. The method of claim 29 wherein the overlaid material covers a substantial part of the interior surface.

31. The method of claim 30 wherein the overlaid material comprises segments of material.

32. The method of claim 31 wherein each segment is selected to produce a desired beam spread or shape.

33. The method of claim 29 wherein specularity of the overlaid material is varied according to the desired beam spread or shape.

34. The method of claim 32 wherein the width of each segment is selected according to the desired beam spread or shape.

35. The method of claim 32 wherein the specularity and width of each segment is selected according to the desired beam spread or shape.

36. The lighting fixture of claim 1 wherein the lamp comprises a high intensity discharge lamp.

37. The lighting fixture of claim 36 wherein the high intensity discharge lamp includes an arc tube which has a longitudinal axis and the lamp itself has a longitudinal axis, and the longitudinal axis of the arc tube is offset from a central aiming axis of the reflector.

38. The lighting fixture of claim 37 wherein the arc tube longitudinal axis is offset from the arc lamp longitudinal axis.

39. The lighting fixture of claim 37 wherein the arc tube longitudinal axis is generally coaxial with the lamp longitudinal axis, so that the lamp is tilted relative to the central aiming axis of the reflector.

40. The light fixture of claim 1 wherein the frame has diameter in the range of approximately 12 inches to 36 inches.

41. The fixture of claim 1 wherein the frame is positioned in a surface of revolution selected from one or more of paraboloid, hyperboloid, spheroid and ellipsoid.

42. The fixture of claim 1 wherein the frame is made of aluminum.

43. The fixture of claim 1 wherein the segments are made of aluminum.

44. The fixture of claim 1 where a segment has a portion which is offset from the surface of the reflector to alter the direction of reflected light from the segment as compared to if the segment did not have a portion offset from the surface of the reflector.

* * * * *